US008789729B2

(12) United States Patent
Beckett

(10) Patent No.: US 8,789,729 B2
(45) Date of Patent: Jul. 29, 2014

(54) POLE-MOUNTED GARMENT HANGER AIR DRYER

(76) Inventor: Joel Beckett, Mercer Island, WA (US)

( * ) Notice: Subject to any disclaimer, the term of this patent is extended or adjusted under 35 U.S.C. 154(b) by 0 days.

(21) Appl. No.: 12/748,090

(22) Filed: Mar. 26, 2010

(65) Prior Publication Data

US 2011/0073625 A1 Mar. 31, 2011

Related U.S. Application Data

(60) Provisional application No. 61/163,764, filed on Mar. 26, 2009.

(51) Int. Cl.
*A41D 27/22* (2006.01)

(52) U.S. Cl.
USPC ..... 223/88; 223/70; 223/120

(58) Field of Classification Search
USPC ..... 223/85, 88, 92, 69, 51, 70, 120
See application file for complete search history.

(56) References Cited

U.S. PATENT DOCUMENTS

| | | | | | |
|---|---|---|---|---|---|
| 863,820 | A * | 8/1907 | Wingert | ..... | 223/90 |
| 3,892,047 | A * | 7/1975 | Muller-Scherak | ..... | 34/103 |
| 4,592,497 | A * | 6/1986 | Georges | ..... | 223/69 |
| 5,687,278 | A * | 11/1997 | Turner | ..... | 223/70 |
| 6,047,482 | A * | 4/2000 | Roper | ..... | 34/106 |
| 2006/0226177 | A1 * | 10/2006 | McJunkin | ..... | 223/85 |
| 2007/0164062 | A1 * | 7/2007 | Clopton et al. | ..... | 223/85 |

FOREIGN PATENT DOCUMENTS

| | | | | | |
|---|---|---|---|---|---|
| JP | 10000298 | A * | 1/1998 | ..... | D06F 73/00 |
| JP | 10057700 | A * | 3/1998 | ..... | D06F 59/02 |
| JP | 2003230476 | A * | 8/2003 | ..... | A47G 25/28 |
| WO | WO 2008111982 | A1 * | 9/2008 | ..... | D06F 59/02 |

* cited by examiner

*Primary Examiner* — Nathan Durham
(74) *Attorney, Agent, or Firm* — Dean A. Craine

(57) ABSTRACT

A garment hanger air dryer used to quickly and evenly dry simultaneously multiple garments. The dryer includes an upper garment support structure used to hang multiple wet garments. The support structure includes an upper shoulder component and a lower horizontal support rod suspended therefrom. Extending upward from the upper shoulder component is a hot air blower assembly used to deliver hot air into and around multiple garments hung from the upper shoulder component and support rod. In one embodiment, the support structure is selectively attached to the upper end of a height adjustable support pole. The blower assembly may include a hook that allows it to be hung from an upper hook or support bar. During operation, a garment is hung around the upper shoulder component and a pair of pants may be hung from the support rod. Hot air is forced downward and under the upper shoulder component and circulated.

4 Claims, 4 Drawing Sheets

POLE-MOUNTED GARMENT HANGER AIR DRYER

COPYRIGHT NOTICE

Notice is hereby given that the following patent document contains original material which is subject to copyright protection. The copyright owner has no objection to the facsimile or digital download reproduction of all or part of the patent document, but otherwise reserves all copyrights whatsoever.

This utility patent application is based on and claims the benefit of U.S. provisional patent application Ser. No. 61/163,764, filed on Mar. 26, 2009.

BACKGROUND OF THE INVENTION

1. Field of the Invention

This invention pertains to hot air dryers used to quickly dry garments, such as pants, jackets, shirt sweaters, mittens, hats, and shoes.

2. Description of the Related Art

Snowboarders, skiers, snowmobilers and other individuals who play and work outdoors in the rain and snow, need to quickly dry their wet jackets and pants so that it may be worn the next day. Typically, the jackets and pants are hung on a hanger or over a bar in a warm bathroom or utility room and allowed to dry overnight. Unfortunately, the amount of time available overnight is not a sufficient amount of time to completely dry a saturated jacket or pair of pants. Also, because the garments are usually made of water resistant material that impedes movement of moisture into and out of the inner layers, the inner layers and seams may be damp the next morning.

Many cabins and ski lodges used by snowboarders, skiers, and snowmobilers are relatively small buildings with limited warm places for hanging wet clothing. While some hooks or shower bars may be available for hanging a few wet garments, there usually not enough hooks and shower bars for all of the guests.

Accordingly, it is an object of the present invention to provide a portable, garment drying apparatus that can individually support and uniformly dry multiple different kinds of garments in a quick manner.

SUMMARY OF THE INVENTION

The foregoing object and other objects of the present invention are attained in a multiple garment drying apparatus disclosed herein that includes a hot air source and blower assembly mounted on an upper garment support structure. The upper garment support structure is a hanger-like structure that is mounted on the upper end of a height adjustable support pole. The upper garment support structure includes a left shoulder extension and a right shoulder extension similar to the upper garment support structure disclosed in U.S. provisional patent application Ser. No. 61/163,632, filed on Mar. 26, 2009, its co-pending utility patent application Ser. No. 12/732,622, filed on Mar. 26, 2010, and now incorporated by reference herein. Disposed over the central opening on the upper shoulder component is a hot air source and blower assembly.

The upper shoulder component includes a center hub located on its bottom surface that allows the upper shoulder component to be selectively attached to the upper end of the support pole. Extending below the upper shoulder component is a horizontally aligned garment support rod. The support rod is held in position by two offset side brackets that extend downward from the bottom surface of the upper shoulder component. In the embodiment shown herein, the support pole is telescopic and includes three collapsing legs that allows the support pole to collapse into a compact configuration for easy transport and storage. Mounted to the top of the blower assembly is an optional hook that allows the upper shoulder component and blower assembly to be hung from a hook or bath curtain rod when the support pole is detached and not needed.

During operation, the upper shoulder component may be mounted on the support pole or hung from a hook or bath curtain rod near a 15 volt A.C. electrical plug-in. A coat, jacket or sweater is hung or draped over the upper shoulder component and a pair of pants or shirt may be hung from the support rod. Alternatively, a hanger with a garment hung thereon may be hung from the support rod. The blower assembly is the plugged into the electrical plug-in and activated. Air heat is then forced downward into the cavity formed by a jacket or shirt hung over the upper shoulder component and over any garments hung over the support rod or on a hanger attached to the support rod.

DESCRIPTION OF THE PREFERRED EMBODIMENT(S)

Figure 1:
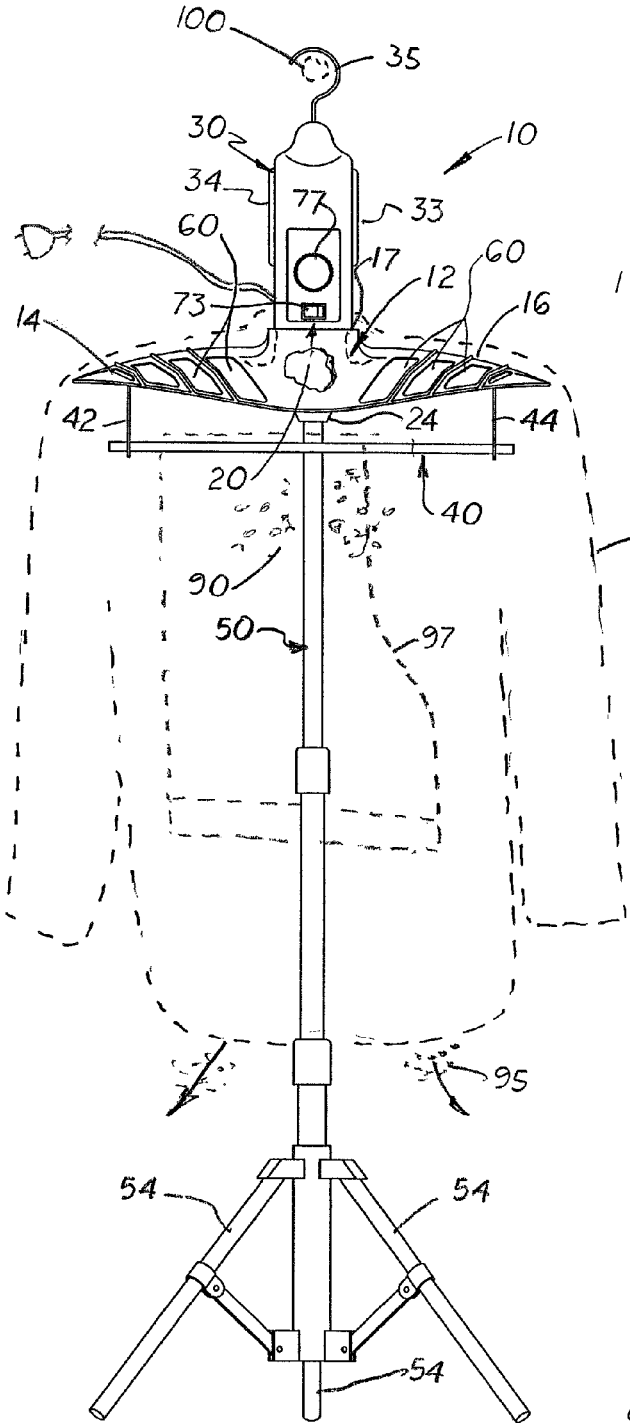
FIG. 1 is a front elevational view of the pole mounted, garment hanger air dryer.

Referring to the FIGS. 1-5, there is shown a pole-mounted, garment drying apparatus 10 that includes an upper shoulder component 12 with a hot air source and blower assembly 30 mounted thereon. The upper shoulder component 12 includes a hub 24 located on its bottom surface 13 that enables the upper garment component 12 to be selectively attached to a height adjustable support pole 50.

Figure 4:
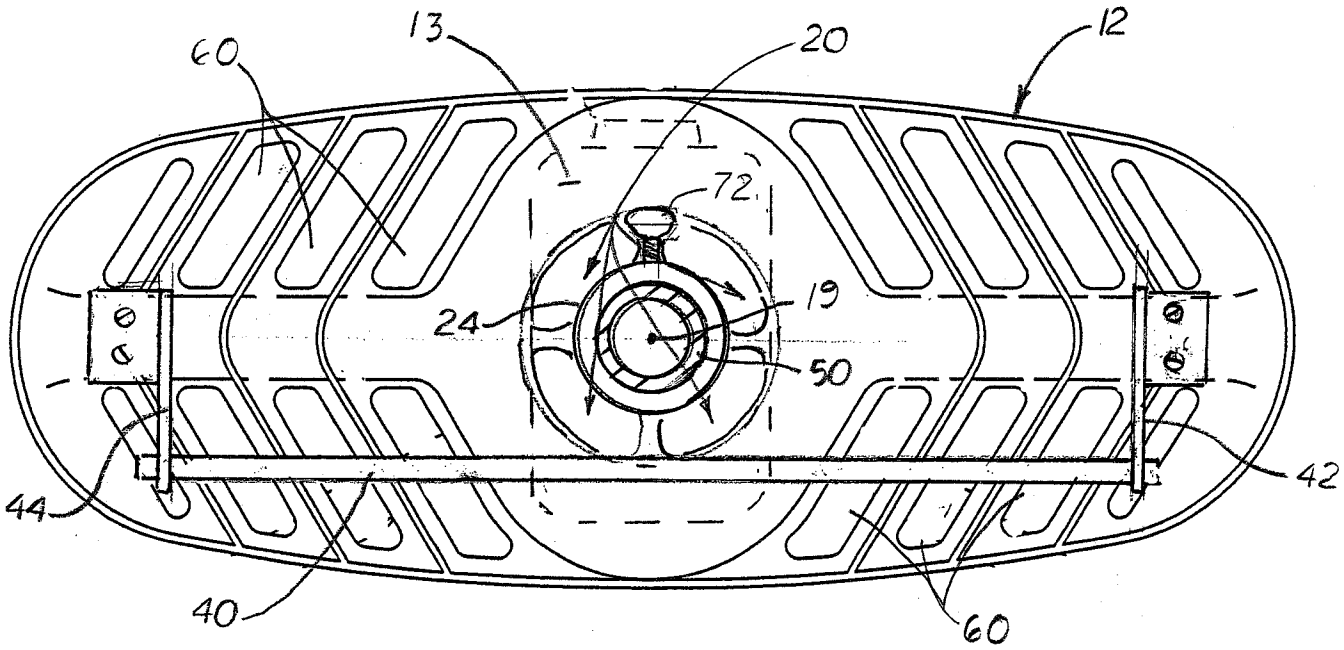
FIG. 4 is a bottom plan view of the upper shoulder component.
Figure 5:
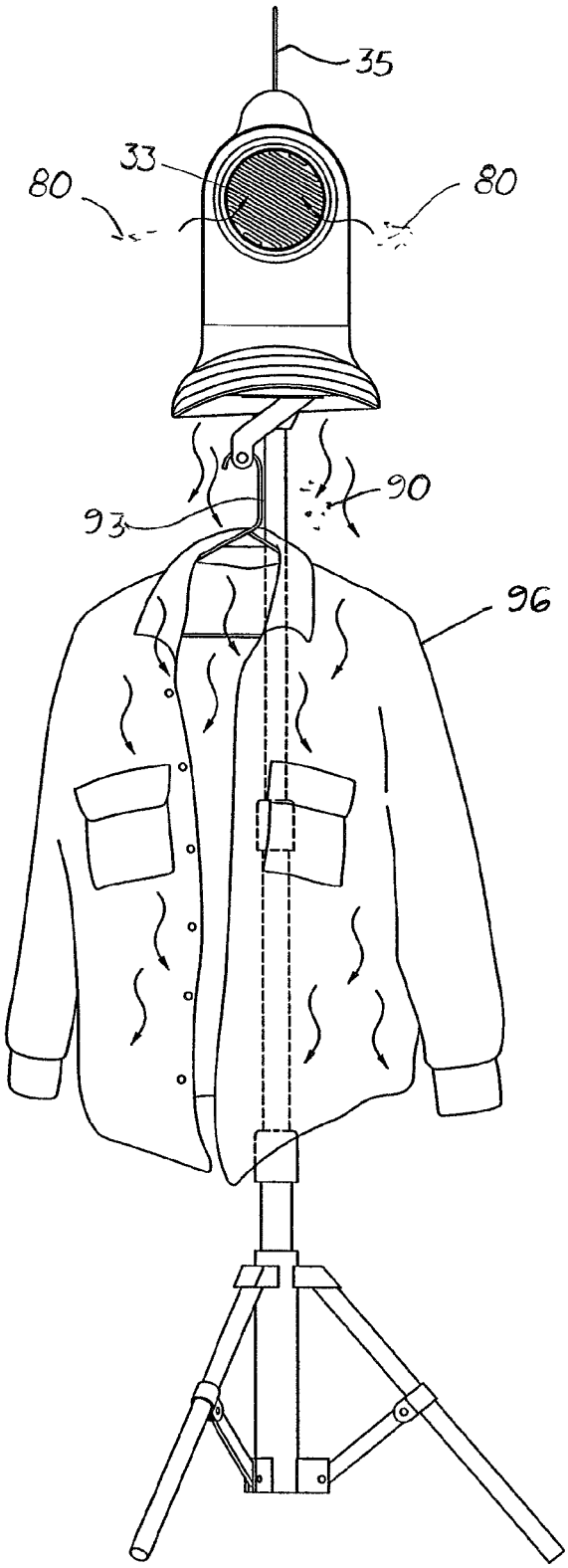
FIG. 5 is a front elevational view of the pole mounted garment hanger air dryer showing a jacket hung over the upper shoulder component and being dried.

The hub 24, shown more clearly in FIG. 4, is located centrally on the bottom surface 13 thereby enabling the support pole 50 to be aligned with the upper shoulder component's center axis 19. The upper shoulder component 12 includes a, slightly curved left shoulder extension 14 and a, slightly curved right shoulder extension 16. Formed between the left and right shoulder extensions 14, 16 is a flat platform 17 with a center opening 20 formed therein. During assembly, the hot air and blower assembly 30 with a lower output port 32 formed on its lower surface is positioned on the flat platform 17 so that the output port 32 is aligned and registered with the center opening 20. Hot air 90 may be forcible blown downward through the center opening 20 and directly into the space located under the upper shoulder component 12.

The two shoulder extensions 14, 16 includes a plurality of air vents 60 that enable air 90 delivered below the upper shoulder component 12 to travel upward and through the upper garment support structure 12 and contact the upper shoulder area of a jacket or coat 95.

Figure 2:
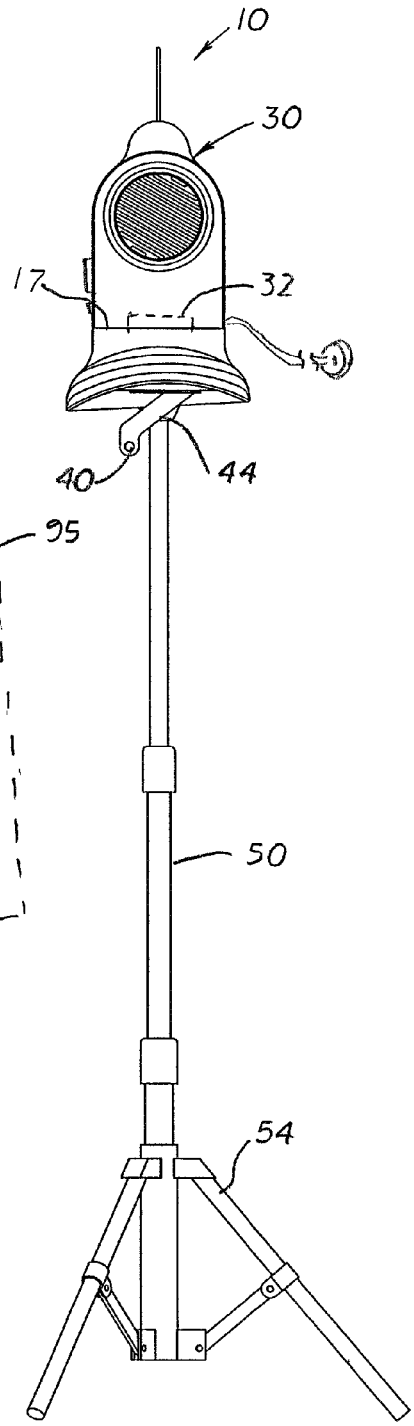
FIG. 2 is a side elevational view of the invention.
Figure 3:
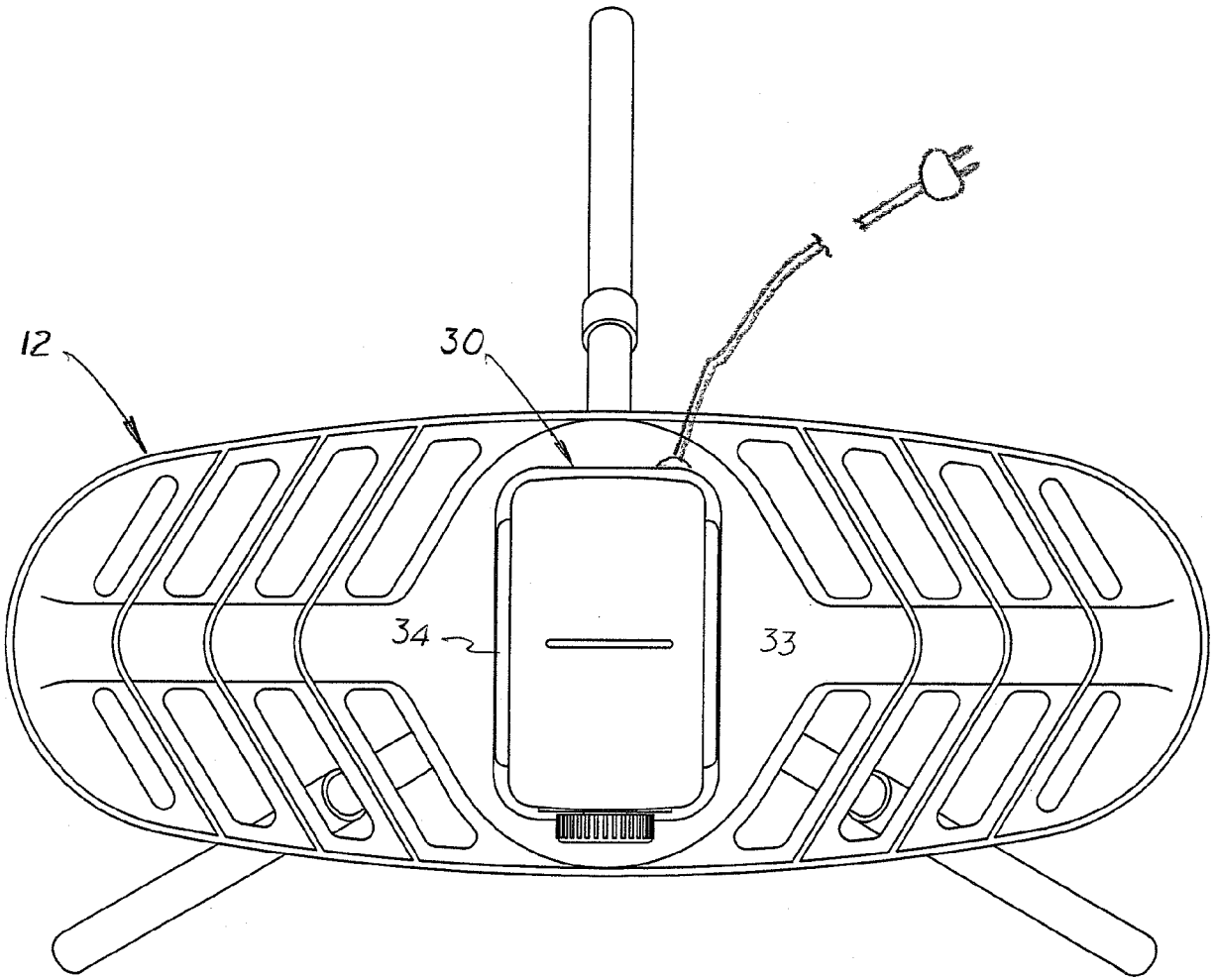
FIG. 3 is a top plan view of the upper shoulder component.

Located below the upper garment shoulder component 12 is a horizontally aligned support rod 40. The support rod 40 is selectively attached to the upper shoulder component 12 via two upward extending side brackets 42, 44 that attached at their upper ends to the bottom surface 13 of the upper shoulder component 12. The side brackets 42, 44 are bent in one direction so that the support rod 40 may be aligned to one side of the support pole 50 as shown in FIGS. 2 and 3. Mounted to the top of the blower assembly 30 is an optional hook 35 that allows the blower upper shoulder component 12 and the blower assembly 30 to be hung from a closet or shower curtain bar 100.

The upper shoulder component 12 is made of PVC and measures approximately 16 to 20 inches in length, 4 to 6 inches width, and 2 to 4 inches in height. The center platform 17 measures approximately 5 inches in length and 3 inches in width. The support rod 40 is made of aluminum or PVC and measures approximately 12 to 15 inches in length and ½ to ¾ inches in diameter. The side brackets 42, 44 are made of PVC and measure approximately 3 to 6 inches in length. The support pole 50 is made of aluminum or PVC and is approximately 1 inch in diameter and may adjust in length between 16 to 60 inches.

The electric hot air source and blower assembly 30 may include a main ON-OFF switch 73 that controls an internal fan and heater and a heater thermostat switch 77 that regulates operation of the internal heater.

During operation, fresh air 80 is drawn into two fresh air ports 33, 34 on the hot air source and blower assembly 30. Hot air 90 from the hot air source and blower assembly 30 is then forced downward into the space located below the upper shoulder component 12. Air vents 60 in the left and right shoulder extensions 14, 16 enable hot air 90 to travel through the upper shoulder component 50 and contact the inside surface of the jacket 95 or sweater hung over the upper shoulder component 50. The upper garment component 12 is sufficiently wide and long so that a jacket 95, sweater, or coat hung around the upper garment component 12 may be closed to form an inner cavity that confines the hot air 90. Hot air 90 from the hot air source and blower assembly 30 is then forced downward into the cavity and then is circulated upward and through the upper garment component to heat and dry the inside surface of the shoulders and eventually cools and exits through the jacket's waist opening.

In compliance with the statute, the invention described herein has been described in language more or less specific as to structural features. It should be understood however, that the invention is not limited to the specific features shown, since the means and construction shown, is comprised only of the preferred embodiments for putting the invention into effect. The invention is therefore claimed in any of its forms or modifications within the legitimate and valid scope of the amended claims, appropriately interpreted in accordance with the doctrine of equivalents.

I claim:

1. A pole-mounted, garment hanger air dryer apparatus for quickly and simultaneously drying multiple garments, comprising:

a. a hanger-like upper shoulder component that includes two shoulder extensions, a center platform formed therebetween, and a center axis, formed on said center platform is a center opening and extending downward from said upper shoulder component is a circular hub coaxially aligned with said center axis, said hub disposed inside said center opening and configured to allow air flowing downward through said center opening to flow through said center opening and around said hub and into a space under said upper shoulder component and flow against garments in the space, each said shoulder extension includes a plurality of vent openings that allow air to flow upward from the space under said shoulder extension and contact a section of garment hung over said shoulder extension;

b. with a horizontal support rod located below and parallel with said upper shoulder component, said support rod coupled to said upper shoulder component and offset from said hub;

c. a height adjustable, self-supporting support pole attached to said hub on said upper shoulder component; and, d. a hot air source and blower assembly mounted over said upper shoulder component and aligned over said center opening, said hot air source forces hot air through said center opening and around said hub and said support pole into a space located under the upper shoulder component, whereby when a garment is hung over said upper shoulder component or hung from said support rod, hot air delivered through said center opening flows evenly over the garments and dries them.

2. The pole-mounted, garment hanger air dryer, as recited in claim 1, further including a hook attached to said hot air source and blower assembly enabling said apparatus to be hung from a hook or rod.

3. The pole-mounted, garment hanger air dryer, as recited in claim 1, wherein said support pole is telescopic.

4. The pole-mounted, garment hanger air dryer, as recited in claim 1, wherein said upper shoulder component is made of PVC.

* * * * *